US008185026B2

(12) United States Patent
Shirafuji

(10) Patent No.: US 8,185,026 B2
(45) Date of Patent: May 22, 2012

(54) IMAGE FORMING APPARATUS

(75) Inventor: Yasuhito Shirafuji, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 347 days.

(21) Appl. No.: 12/695,286

(22) Filed: Jan. 28, 2010

(65) Prior Publication Data

US 2010/0196033 A1 Aug. 5, 2010

(30) Foreign Application Priority Data

Jan. 30, 2009 (JP) ..... 2009-020237

(51) Int. Cl.
*G03G 15/16* (2006.01)
*G03G 15/01* (2006.01)

(52) U.S. Cl. ..... 399/296; 399/302

(58) Field of Classification Search ..... 399/296, 399/302, 308, 315
See application file for complete search history.

(56) References Cited

U.S. PATENT DOCUMENTS 5,740,508 A * 4/1998 Matsuura et al. ..... 399/308
7,440,719 B2 * 10/2008 Kimura et al. ..... 399/296

FOREIGN PATENT DOCUMENTS

JP 2002-82532 3/2002
JP 2004-317915 11/2004
JP 2007003634 A * 1/2007
JP 2007-240750 9/2007

* cited by examiner

*Primary Examiner* — David Gray
*Assistant Examiner* — Gregory H Curran
(74) *Attorney, Agent, or Firm* — Canon USA Inc IP Division

(57) ABSTRACT

An electric charge elimination needle for eliminating an electric charge of an intermediate transfer belt is disposed on the side more downstream than an opposite sheet metal which restricts an electric potential on the belt, in a direction of rotation of the intermediate transfer belt, thereby preventing a toner image on the intermediate transfer belt carried with tension by a plurality of tension rollers, from disorder when the intermediate transfer belt contacts and is detached from the tension roller.

7 Claims, 8 Drawing Sheets

IMAGE FORMING APPARATUS

BACKGROUND OF THE INVENTION

1. Field of the Invention

The present invention relates to an image forming apparatus such as an electro-photographic copying machine and printer including an intermediate transfer belt.

2. Description of the Related Art

Recently, an intermediate transfer belt type image forming apparatus has been known which primarily transfers a toner image formed on a photosensitive drum (image carrier) onto an intermediate transfer belt suspended by a plurality of tension rollers to secondarily transfer the toner image on the intermediate transfer belt onto a recording material. This intermediate transfer belt type image forming apparatus transfers the toner image formed on the image carrier in a lump. Thus, the intermediate transfer belt type image forming apparatus has the advantage of high suitability for the recording material. Further, the intermediate transfer belt type image forming apparatus has a structure for tensing an intermediate transfer belt by a plurality of tension rollers. Thus, intermediate transfer belt type image forming apparatus has the advantage of relatively freely stretching and rotating a belt, and allowing an image forming apparatus to be miniaturized.

However, the following problem will arise when this intermediate transfer belt is adopted as a high-speed image forming apparatus and a miniaturized image forming apparatus.

Time that the intermediate transfer belt electrically charged in primary transfer takes to move from a primary transfer portion to a secondary transfer unit, is short. Thus, an electric charge retained in the intermediate transfer belt cannot sufficiently be attenuated. This will cause a portion of the intermediate transfer belt, which cannot be attenuated, to come close to the grounded tension roller for tensing the intermediate transfer belt.

On the other hand, in such a configuration, as the intermediate transfer belt electrically charged in the primary transfer draws apart from the image carrier and the transfer member, the intermediate transfer belt is led to a high electric potential. As a result of this, an electric potential difference between the intermediate transfer belt and the tension roller or members in the vicinity thereof becomes large and generates an electric discharge in a minute void part.

When the electric discharge is generated, a phenomenon occurs in which a toner on the intermediate transfer belt is electrically charged with a polarity reverse to a normal electric-charge polarity. Thus, a problem arises in which the toner electrically charged with a reverse polarity is not transferred onto the recording material in the secondary transfer.

This phenomenon will be described using FIG. 7.

First, an electric potential difference between an intermediate transfer belt and a tension roller needs to receive attention. Previously, an electric potential Vitb of the intermediate transfer belt after primary transfer can be represented by the following equation:

$$Vitb=(Qitb+Croll\,Vroll+Cdrum\,Vdrum)/(Croll+Cdrum) \quad (1)$$

where Vitb denotes an electric potential of the intermediate transfer belt, Vroll denotes a surface electric potential of primary transfer, Vdrum denotes a surface electric potential of an image carrier, Qitb denotes the amount of an electric charge accumulated in the intermediate transfer belt, Croll denotes an electric capacity between the intermediate transfer belt and a primary transfer roll, and Cdrum denotes an electric capacity between the intermediate transfer belt and a photosensitive drum. The surface resistivity of the intermediate transfer belt is $10^{10}\Omega/\square$ to $10^{13}\Omega/\square$ and the volume resistivity of the intermediate transfer belt is $10^{7}\ \Omega\cdot cm$ to $10^{12}\ \Omega\cdot cm$.

In a configuration in which the attenuation of the amount of an electric charge Qitb is small, an electric potential difference between the intermediate transfer belt and the tension roller is changed by an electric capacity between a belt and a drum, and an electric capacity between a belt and a primary transfer roller.

As an example, a high-speed image forming apparatus in which a travel speed of an intermediate transfer belt is 500 mm/sec. will be described. With respect to the amount of an electric charge Qitb accumulated in the intermediate transfer belt, self attenuation of an electric charge of a belt does not sufficiently occur until the belt reaches a downstream tension roller as the belt travels downstream.

On the other hand, respective electric capacities Croll and Cdrum are inversely proportional to a distance between a belt and a drum, and a distance between a belt and a primary transfer roller. Thus, as the intermediate transfer belt travels, the respective electric capacities Croll and Cdrum decrease.

On the other hand, when a plurality of tension rollers is present, a part of an electric charge of the intermediate transfer belt will be eliminated by a tension roller which is first brought into contact therewith after primary transfer. However, in an intermediate transfer belt which travels at a high speed, it is difficult to eliminate an entire electric charge.

As a result of this, the electric potential of the intermediate transfer belt is increased with the above-described equation. Thus, an electric discharge will occur when a part having a large electric potential is brought into contact with the grounded another tension roller or passes through the vicinity of another member.

This electric discharge reverses a polarity of a toner in a portion receiving the electric discharge. Thus, the toner with the reversed polarity is not transferred in a secondary transfer portion. Hence, a white patch which is referred to as an electric discharge trace also occurs.

Thus, Japanese Patent Application Laid-Open No. 2002-82532 is configured to provide an electric charge elimination brush which comes into contact with the reverse side of the intermediate transfer belt to eliminate an electric charge, in the upstream part of the tension roller with which the intermediate transfer belt passing through the primary transfer portion first brings into contact. Further, Japanese Patent Application Laid-Open No. 2004-317915 is configured to dispose an electric charge elimination needle as an electric charge elimination unit.

On the other hand, as a method for controlling an electric potential of an intermediate transfer belt, Japanese Patent Application Laid-Open No. 2007-240750 is configured to dispose a sheet metal member arranged at a predetermined interval between itself and the intermediate transfer belt in a position opposite to the intermediate transfer belt. When such a configuration to eliminate an electric charge of the intermediate transfer belt is adopted, the following problem may arise depending on an electric charge elimination point. Even if the electric charge elimination brush is provided in a position more upstream than a position where the intermediate transfer belt first brings into contact with the tension roller, when the electric charge elimination brush is disposed in an area opposite to the metal member, an electric discharge may occur between the tension roller or the like on the downstream side and the intermediate transfer belt.

This is because the electric potential of the intermediate transfer belt is restricted by the metal member, an electric potential difference between the electric charge elimination member and the intermediate transfer belt is reduced, and an electric charge cannot be sufficiently eliminated. As a result of this, after the intermediate transfer belt passes through the image carrier and the metal member, the electric potential of the intermediate transfer belt increases again.

A relevant mechanism will be described using FIG. 8.

As illustrated in FIG. 8, an electric potential of an intermediate transfer belt after primary transfer can be represented by the following equation:

$$Vitb=(Qitb+\mathrm{Croll}\,V\mathrm{roll}+CmVm)/(\mathrm{Croll}+Cm) \quad (2)$$

where Vitb denotes an electric potential of the intermediate transfer belt, Vroll denotes a surface electric potential of a primary transfer roller, Vm denotes a surface electric potential of a metal member, Qitb denotes the amount of an electric charge accumulated in the intermediate transfer belt, Croll denotes an electric capacity between the intermediate transfer belt and the primary transfer roll, and Cm denotes an electric capacity between the intermediate transfer belt and the metal member. The amount of an electric charge Qitb accumulated in the belt denotes the amount of a toner electric charge of a transferred toner and an electric charge supplied in the primary transfer portion, and is roughly constant similarly to the previous one.

Further, as illustrated in FIG. 8, in an area in which the intermediate transfer belt and the metal member are opposed to each other, a distance between the intermediate transfer belt and the metal member is roughly fixed. Thus, an increase in the electric potential of the intermediate transfer belt is limited. However, after passage of the metal member, the distance is gradually increased. Thus, an electric potential difference between the belt and the metal members starts to be increased.

Essentially, the belt electric potential is attenuated with time. However, when a travel speed of the intermediate transfer belt is fast, the intermediate transfer belt is brought into contact with the tension roller before the belt electric potential is sufficiently attenuated.

As a result of this, after the intermediate transfer belt passes through an area opposite to the metal member, the electric potential of the intermediate transfer belt is increased. Thus, an electric discharge phenomenon occurs in the tension roller or the like.

Thus, it is desirable to eliminate an electric charge in a part opposing the metal member in which an increase in the electric potential of the intermediate transfer belt is large.

On the other hand, in order to sufficiently eliminate an electric charge, in other words, eliminate an electric charge by an electric discharge in an area where an increase of such the electric potential is large, it is effective to use an electric charge elimination member which is not in contact with an object to be electrically discharged.

SUMMARY OF THE INVENTION

The present invention is directed to elimination of an electric charge of an intermediate transfer belt in a part in which the electric potential of the intermediate transfer belt is large, by an electric charge elimination member that is not in contact with the intermediate transfer belt.

According to an aspect of the present invention, an image forming apparatus includes an image forming unit configured to have an image carrier to form a toner image on the image carrier; a rotatable intermediate transfer belt for bearing the toner image transferred from the image carrier; a plurality of tension members for tensing the intermediate transfer belt; a primary transfer unit configured to transfer the toner image formed on the image carrier onto the intermediate transfer belt; a secondary transfer unit configured to transfer the toner image formed on the intermediate transfer belt onto a recording material; a sheet metal unit disposed with a preset interval between itself and a face on which the intermediate transfer belt carries the toner image, on the side more downstream than the primary transfer unit and on the side more upstream than the secondary transfer unit in a travel direction of the intermediate transfer belt; and a noncontact electric charge elimination member for eliminating an electric charge of the intermediate transfer belt which is disposed on the side more downstream than the metal unit and on the side more upstream than the secondary transfer unit in the travel direction, and is provided in noncontact with the intermediate transfer belt opposing the side adverse to the face on which the intermediate transfer belt carries the toner image.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
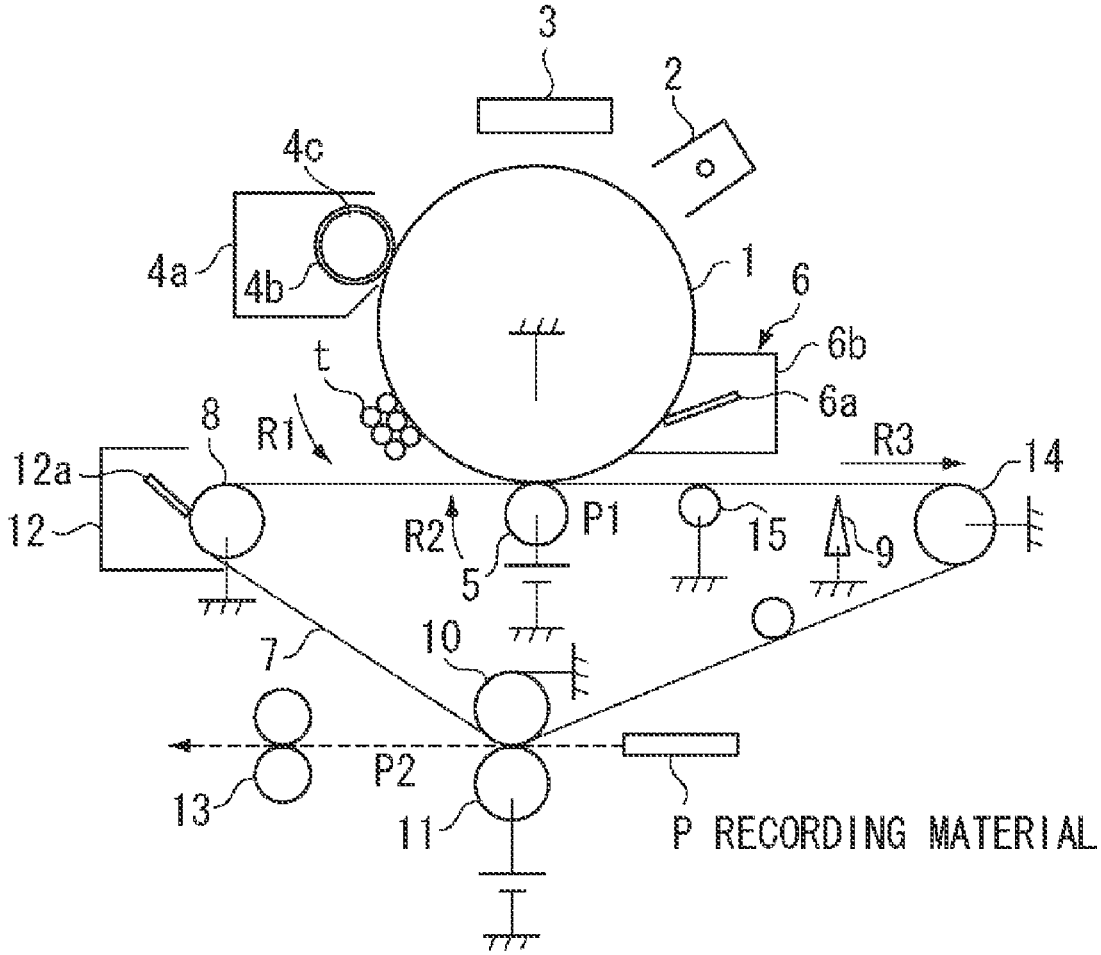
FIG. 1 illustrates a schematic diagram of an image forming apparatus according to a first exemplary embodiment of the present invention.

An exemplary embodiment of an image forming apparatus according to the present invention will be described below. FIG. 1 is a schematic diagram illustrating a configuration example of an image forming apparatus according to a first exemplary embodiment.

In FIG. 1, around a photosensitive drum 1 as an image carrier, an electricity charging device 2, an exposure device 3, a development device 4, a cleaning device 6, and a primary transfer roller 5 as a primary transfer member that forms a primary transfer portion P1 are disposed. Further, in the present exemplary embodiment, an intermediate transfer belt method is adopted in which a toner image t formed on the photosensitive drum 1 is transferred onto a rotatable intermediate transfer belt 7 and the toner image on the intermediate transfer belt is transferred onto a recording material in a secondary transfer portion.

The photosensitive drum 1 is an amorphous silicon drum, which has a positive electric-charge polarity. The photosensitive drum 1 is rotated at a peripheral speed of 500 mm/sec. in a direction of an arrow R1 by a motor serving as a driving unit.

When an image forming signal for forming an image is input, a predetermined preliminary rotation is implemented, then an image forming operation is started. The image forming operation will be described below.

First, as the photosensitive drum 1 is rotating, a voltage preset by an electric power source is applied to the electricity charging device 2. Thus, the surface of the photosensitive drum 1 is uniformly electrically charged. An electricity charging device in the present exemplary embodiment is a corona charging device. In the present exemplary embodiment, the photosensitive drum 1 is electrically charged at an electric potential of +600 V by the electricity charging device 2.

In a rotation direction R1 of the photosensitive drum 1, on the downstream side of the electricity charging device 2, the exposure device 3 is disposed. The exposure device 3 scans based on image information while laser radiation is turned ON/OFF to expose the photosensitive drum 1. Thus, an electrostatic latent image corresponding to the image information is formed on the photosensitive drum 1. In the present exemplary embodiment, an exposure unit is set at an electric potential of +150 V.

The development device 4 is disposed on the downstream side of the exposure device 3 in a travel direction of the photosensitive drum 1. The present exemplary embodiment is configured to use a single-component developer (black toner). The development device 4 develops the formed electrostatic latent image. The development device 4 has a container 4*a* which contains a toner. Further, in a portion opposite to the photosensitive drum 1 of its container 4*a*, a development sleeve 4*b* is disposed, which freely rotates. In this development sleeve 4*b*, a magnet roller 4*c* for bearing the developer on the development sleeve 4*b* is secured and disposed. An electric-charge polarity of a toner in the present exemplary embodiment is a negative polarity. A development bias is applied from an electric power source to the development sleeve 4*b*. Thus, the toner adheres to a high electric potential portion of the electrostatic latent image to be developed and a toner image is formed on the photosensitive drum 1. The development bias in the present exemplary embodiment is +300 V. In the present exemplary embodiment, a toner image forming unit includes an electricity charging device, an exposure device, and a development device.

On the other hand, in a vertical direction of the image forming apparatus, below the photosensitive drum 1, the rotatable intermediate transfer belt 7 is disposed in contact with the photosensitive drum 1. The intermediate transfer belt 7 is rotated at a speed (500 mm/s) similar to a photoreceptor. The intermediate transfer belt 7 is tensed by a plurality of tension rollers 8, 10 and 14 serving as a tension member. A first tension roller 8 is a driving roller which is rotated by a driving motor and transmits a driving force to the intermediate transfer belt 7. A second tension roller 14 and a third tension roller 15 are driven rollers to be driven and rotated accompanying the travel of the intermediate transfer belt 7. Further, a fourth tension roller 10 is a secondary transfer internal roller for forming a secondary transfer portion P2. In the present exemplary embodiment, these tension rollers are grounded.

The intermediate transfer belt 7 is formed to have volume resistivity of $10^6$ Ω·cm to $10^{10}$ Ω·cm and surface resistivity of $10^{10}$Ω/□ to $10^{13}$Ω/□. The intermediate transfer belt 7 uses a material which contains the suitable amount of an antistatic agent such as carbon black in a resin such as, for example polyimide and polycarbonate.

On a path of the intermediate transfer belt 7, the primary transfer portion P1 and the secondary transfer portion P2 are provided.

The primary transfer portion P1 is a portion where the intermediate transfer belt 7 is provided between the photosensitive drum 1 and the primary transfer roller 5.

The primary transfer roller 5 is configured to press the photosensitive drum 1 by a pressing member such as a spring (not shown). The primary transfer roller 5 is driven and rotated in a direction of an arrow R2 along with rotation in a direction of an arrow R3 of the intermediate transfer belt.

The primary transfer roller 5 in the present exemplary embodiment includes a shaft made of stainless steel (SUS in Japanese Industrial Standard (JIS)) with a diameter ϕ of 8 mm, and an ionic conductivity urethane sponge layer with a thickness of 4 mm and a width of 315 mm. The resistance value of the primary transfer roller is about $4\times10^7$Ω (at 23° C. and 50% relative humidity (RH)). The resistance value is determined from a relation of an electric current measured by rotating the transfer roller at a peripheral speed of 500 mm/s and applying a voltage of +3,000 V on the surface of the transfer roller when being grounded under a load of 500 g weight.

A predetermined voltage with a positive polarity which is a polarity reverse to a polarity of a developer is applied from an electric power source to the primary transfer roller 5. Thus, the toner image on the photosensitive drum 1 is transferred onto the intermediate transfer roller 7.

In the control of a voltage to the primary transfer roller 5, the present exemplary embodiment causes a control unit (central processing unit (CPU)) to execute constant electric current control. In the present exemplary embodiment, the constant electric current control is executed so as to provide an electric current of +50 μA to +70 μA. This constant electric current value is changed according to an environment.

Concerning a toner remaining on the photosensitive drum 1 after primary transfer, an adhesion material such as a remaining toner is removed by the cleaning device 6.

The cleaning device 6 includes a cleaning blade 6*a* and a toner recovery container 6*b*. The cleaning blade 6*a* abuts on the photosensitive drum 1 at a predetermined angle and pressure of a pressurizing unit (not shown) to recover the toner or the like remaining on the surface of the photosensitive drum 1 after primary transfer.

The recovery container 6*b* is configured by a frame body made of a metal such as, for example SUS and grounded. A portion opposite to a face on which the toner image of the intermediate transfer belt 7 is carried is made of a metal sheet (sheet metal member).

The toner image formed on the intermediate transfer belt 7 travels to the secondary transfer portion P2.

A secondary transfer external roller 11 includes a shaft made of SUS with a diameter ϕ of 12 mm, and an ionic conductivity urethane sponge layer with a thickness of 6 mm and a width of 330 mm. This secondary transfer external roller is configured to press a secondary transfer internal roller 10 via the intermediate transfer roller 7. The secondary transfer portion P2 for transferring the toner on the intermediate transfer roller 7 is formed on the recording material by these secondary transfer internal roller 10 and secondary transfer external roller 11. The resistance value of the secondary transfer external roller 11 is about $6\times10^7\Omega$ (at 23° C. and 50% RH). The resistance value is determined from a relation to an electric current measured by rotating the transfer roller at a peripheral speed of 500 mm/s and applying a voltage of 3,000 V to the surface of the transfer roller under a load of 500 g weight.

In the present exemplary embodiment, the secondary transfer portion adopts constant voltage control.

This is because the secondary transfer portion needs to perform sufficient transfer on various recording materials different in a size and a type, and a transfer voltage needs to be applied in consideration of a voltage that a paper has to share.

The secondary transfer portion needs to execute active transfer voltage control (ATVC) in order to determine an applied voltage.

The ATVC to be implemented in the present exemplary embodiment is executed during rotation before image forming. In the ATVC, three different voltages are applied, and an electric current value which flows at that time is detected. Then, from its result, a voltage value as to a target electric current is calculated. This ATVC is executed in preliminary rotation from input of an image forming signal until start of image formation, or in non-image formation in which an image forming operation on a recording material is not executed for each preset number of sheets.

Thus, a voltage of a positive polarity is applied to the secondary transfer external roller 11 from an electric power source based on a result of the ATVC. This causes the toner image t on the intermediate transfer belt 7 to be transferred onto the surface of a recording material P.

A belt cleaning device 12 includes a cleaning blade 12*a*. The cleaning blade 12*a* abuts on the intermediate transfer belt 7 set around a driving roller 8 at a predetermined angle and a pressure to recover a toner or the like remaining on the surface of the intermediate transfer belt 7 after secondary transfer.

The recording material P onto which the toner image is transferred is introduced into a fixing device 13. The toner image is fixed on the recording material P by heat and pressure.

The image forming apparatus includes a control unit (CPU) for controlling an image forming operation such as control of the operation of an electric power source, a bias value and timing for applying a voltage.

Next, a configuration of an electric charge elimination needle which is a noncontact electric charge elimination member will be described as a characteristic feature of the present exemplary embodiment.

Figure 2:
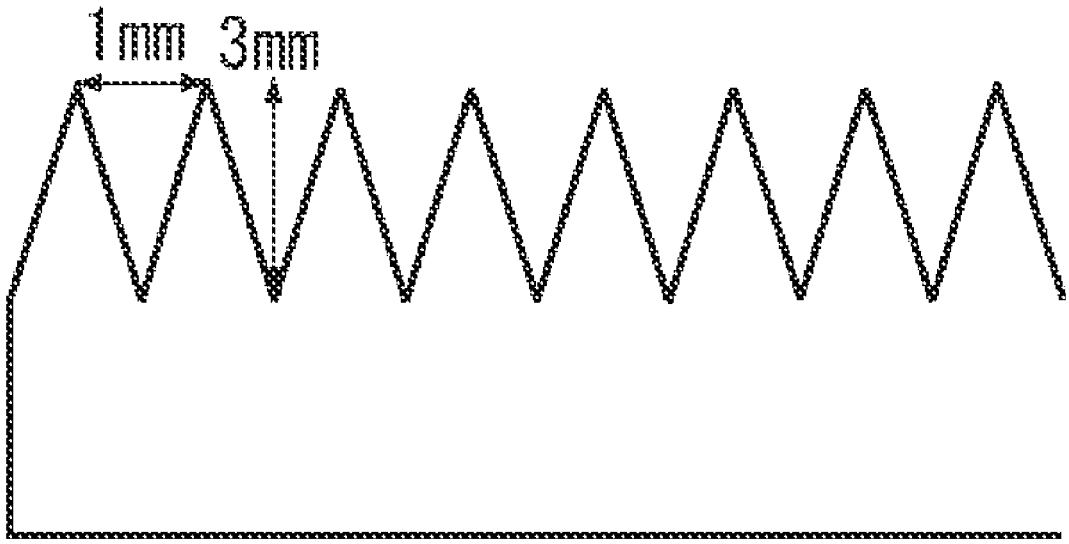
FIG. 2 is a diagram illustrating a shape of an electric charge elimination needle according to the present invention.

An electric charge elimination needle 9 in the present exemplary embodiment includes a conductive metal unit such as SUS. As illustrated in FIG. 2, this metal unit is configured to provide an interval of 1 mm between protruded parts (needle parts), and an interval of 3 mm between the protruded part and the recessed part. Such a needle part is provided in a width direction (direction orthogonal to travel direction) over the entire intermediate transfer belt 7. The electric charge elimination needle has a length of 315 mm in a width direction and has a saw-tooth shape. The length in the width direction of this electric charge elimination needle is longer than a maximum image forming width. This electric charge elimination needle is grounded.

Next, a position where the electric charge elimination needle 9 is disposed will be described.

In the present exemplary embodiment, the electric charge elimination needle 9 is attached in noncontact with the intermediate transfer belt 7, in a position opposite to an adverse face of the transfer belt 7, i.e., on the side adverse to a face on which the intermediate transfer belt 7 carries a toner image. The electric charge elimination needle 9 is disposed in a place where the electric potential of an intermediate transfer belt is increased between the primary transfer portion P1 and the secondary transfer portion P2. More particularly, the electric charge elimination needle 9 is disposed on the side more downstream than a sheet metal unit which will be described later and on the side more upstream than the secondary transfer portion in a travel direction of the intermediate transfer belt 7.

Figure 3:
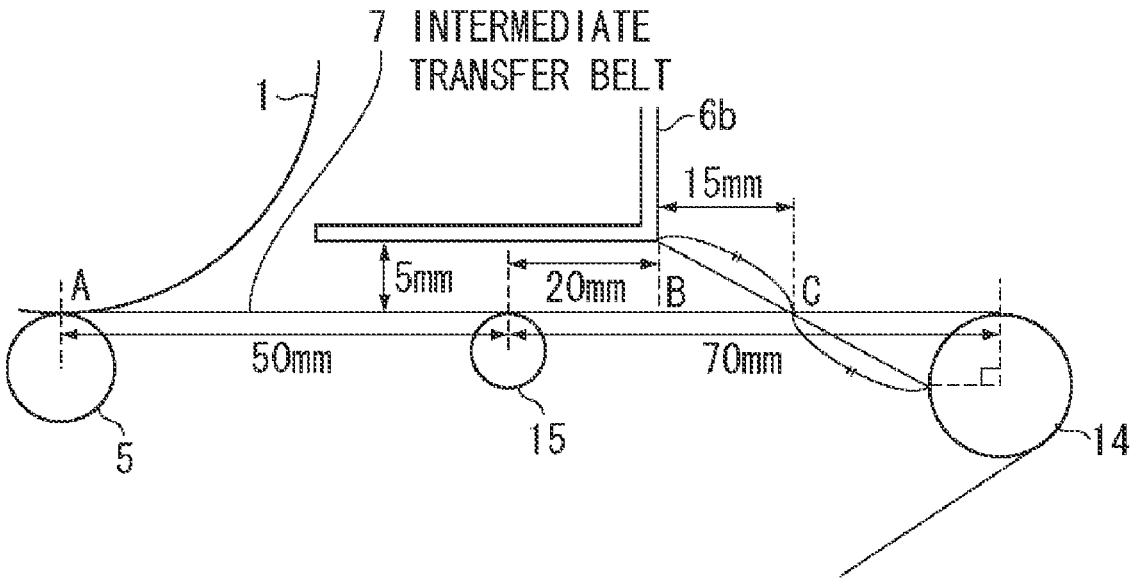
FIG. 3 is a diagram illustrating a principle that a part of a toner image after primary transfer is reversed.

In the image forming apparatus in the present exemplary embodiment, as illustrated in FIG. 3, a tension roller 15 is disposed in a position about 50 mm apart from the primary transfer roller 5 and a tension roller 14 is disposed in a position further about 70 mm downstream there from. The entire surface of the face opposite to the intermediate transfer belt 7 of the cleaning device 6 is metal. In other words, the entire surface thereof is the sheet metal unit. This metal unit is grounded.

Further, the bottom face (metal member) of the cleaning device 6 is disposed with a gap of approximately 5 mm to the intermediate transfer belt 7 from the primary transfer portion P1 to a position about 20 mm downstream from the tension roller 15.

This metal unit serves as an electric potential restriction sheet for restricting the surface electric potential of the intermediate transfer belt 7. Thus, as illustrated in FIG. 3, in an area from a position A of the primary transfer roller of the intermediate transfer belt 7 to the end B of the recovery container 6*b* of the cleaning device 6, the electric potential of the intermediate transfer belt 7 converges on the predetermined electric potential. As a result of this, an increase in an electric potential in this area will be restricted. On the other hand, when the intermediate transfer belt 7 goes over the end B of the recovery container 6*b*, the electric potential of the intermediate transfer belt 7 is not restricted by the metal unit. Thus, the electric potential of the intermediate transfer belt 7 is increased.

Thereafter, the electric potential of the intermediate transfer belt 7 is reduced as it approaches the tension roller 14 since the tension roller 14 is grounded.

As the reason of this phenomenon, as the intermediate transfer belt 7 travels, a relation similar to equation (2) is formed among the tension roller 14, the intermediate transfer belt 7 and the metal unit. As a result, it can be considered that as an electric capacity between the intermediate transfer belt and the tension roller approaches the tension roller 14, a distance between the intermediate transfer belt 7 and the tension roller 14 is reduced and the electric capacity is increased.

Accordingly, the present exemplary embodiment is configured to dispose the electric charge elimination needle 9 between a position located out of the end B of the recovery container 6*b* of the cleaning device 6 and the tension roller 14. The tension roller 14 in the present exemplary embodiment is a solid metal roller. The outside diameter of the solid metal roller is 40 mm.

Further, it can be considered that between the recovery container 6*b* and the tension roller 14, a position having the same distance from respective members is provided with the highest electric potential of the intermediate transfer belt from equation (2). In the present exemplary embodiment, the position is provided by a point (midpoint) in which a distance from the surface of the tension roller to the surface of the intermediate transfer belt 7 is the same as a distance from the tip of the metal unit opposite to the intermediate transfer belt 7 to the surface of the intermediate transfer belt 7. The electric charge elimination needle 9 has been arranged in a position C about 15 mm downstream from the recovery container 6*b* which occupies the above position. At this position, a distance from the tip of the recovery container 6*b* which is the metal unit to the intermediate transfer belt 7 is equal to a distance from the surface of the tension roller 14 to the surface of the intermediate transfer belt 7.

Next, an interval between the electric charge elimination needle 9 and the intermediate transfer belt 7 will be described. With respect to a distance between the needle tip of the electric charge elimination needle 9 and the intermediate transfer belt 7, the closer the distance becomes, the more the electric charge elimination efficiency is improved. In the present exemplary embodiment, in consideration of attachment accuracy of the electric charge elimination needle 9 of ±1 mm, a distance between the intermediate transfer belt 7 and the electric charge elimination needle 9 has been provided by 1.5 mm in the center (0.5 to 2.5 mm). In the present exemplary embodiment, the electric charge elimination needle is used as the electric charge elimination member. As the reason of this, an electric charge is eliminated by a micro electric discharge between the electric charge elimination needle and the surface of the intermediate transfer belt, thereby improving an electric charge elimination effect. Further, unevenness of such a micro electric discharge is small throughout the width direction of the intermediate transfer belt 7, so that unevenness of an electric potential in the width direction of the intermediate transfer belt 7 becomes small. It is not limited to the electric charge elimination needle but instead a brush member can be disposed in noncontact with the intermediate transfer belt to generate the micro electric discharge.

In the present exemplary embodiment, the electric charge elimination needle is provided in a position where it is assumed that an electric potential is highest. However, in the present invention, the disposition of the electric charge elimination needle is not limited to this position. The electric charge elimination effect can be improved even if the electric charge elimination needle is first disposed from a position going over the end of the metal unit and is disposed between grounded tension rollers in a travel direction of the intermediate transfer belt.

For example, in a configuration including a steering roller which controls a position in the width direction of the intermediate transfer belt by an inclination of the tension roller 14, an interval between the intermediate transfer belt and the electric charge elimination needle can be destabilized depending on the degree of inclination of the tension roller 14. Thus, the electric charge elimination needle is disposed on the side more upstream than a position where it is assumed that an electric potential is highest, so that an influence of the inclination of the steering roller on the inclination of the belt face becomes small. Even if the electric charge elimination needle is disposed in such the position, the electric charge elimination effect can be improved.

Further, in a configuration in which the tension roller is absent after passing through the metal unit up to the secondary transfer portion, the electric charge elimination needle is disposed on the side more downstream than a position where the intermediate transfer belt passes through the metal unit and on the side more upstream than the secondary transfer portion in a travel direction of the intermediate transfer belt. By this disposition, the electric charge elimination effect can be obtained.

Figure 4:
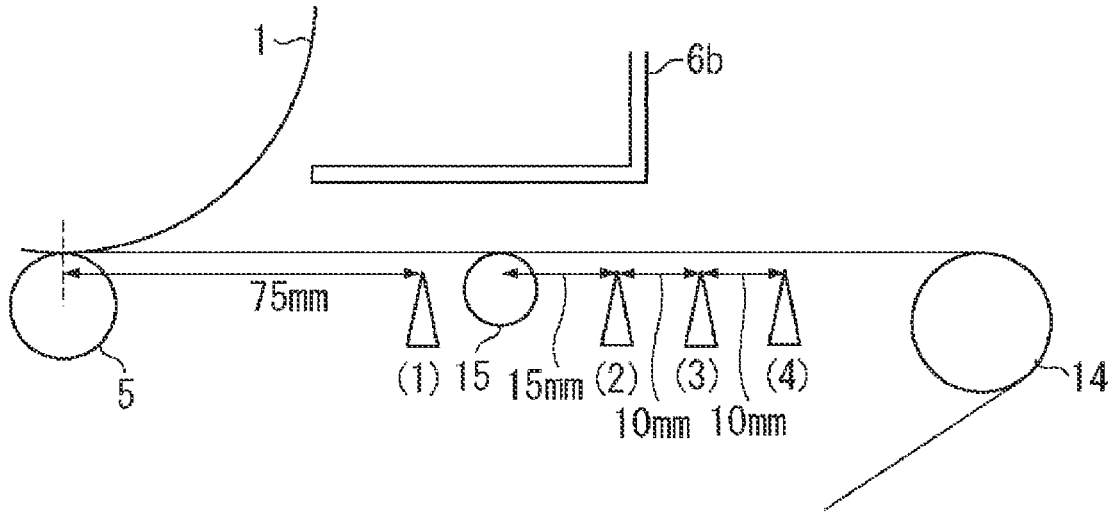
FIG. 4 illustrates a schematic layouts of an electric charge elimination needle when a confirmation experiment is implemented according to a first exemplary embodiment.

In the configuration according to the present exemplary embodiment, it has been verified whether an electric discharge trace is suppressed. In order to verify the effect of the electric charge elimination needle, as illustrated in FIG. 4, the electric charge elimination needle has been disposed in the following position.

First, at a position 1, the electric charge elimination needle is disposed on the side more upstream than the tension roller 15 and about 25 mm downstream from the primary transfer portion. Next, at a position 2, (about 15 mm downstream from tension roller 15), on the side more downstream than the tension roller 15, the cleaning device 6 is disposed opposing the intermediate transfer belt 7. At a position 3 in the present exemplary embodiment, the electric charge elimination needle is disposed 25 mm downstream from the tension roller 15.

At a position 4 in the present exemplary embodiment, the electric charge elimination needle is disposed 35 mm downstream from the tension roller 15. An inflow electric current which flows into respective electric charge elimination needles and the occurrence of an electric discharge trace have been checked.

A distance between the tip of the needle of the electric charge elimination needle 9 and the intermediate transfer belt 7 is evenly 1.5 mm. Further, this verification experiment has been implemented under a normal temperature and low humidity environment (at 23° C. and 50% RH). A primary transfer electric current at that time has been set to +70 μA.

A result when image formation is implemented in the above condition is described below.

TABLE 1

| | Distance from primary transfer portion (mm) | Electric potential on reverse side of intermediate transfer belt (kV) | Inflow electric current into electric charge elimination needle (μA) | Electric discharge trace |
|---|---|---|---|---|
| Position 1 | 25 | 1.5 | 0.6 | X |
| Position 2 | 65 | 2.0 | 1.1 | X |
| Position 3 | 75 | 4.0 | 1.4 | ○ |
| Position 4 | 85 | 5.0 | 1.6 | ○ |

From the result described above, it is to be understood that the belt electric potential in the positions (position 3 and position 4) passing through the metal member (cleaning device 6) opposite to the intermediate transfer belt 7 on the side more downstream than the primary transfer portion P1 is higher than the belt electric potential on its upstream side. Then, the electric charge elimination needle is disposed in an area where the electric potential is high, so that prevention of the occurrence of the electric discharge trace could be confirmed.

In the first exemplary embodiment, a monochromatic image forming apparatus has been described. However, in a second exemplary embodiment, disposition of an electric charge elimination needle in a full color image formation apparatus having a plurality of image forming units will be described.

Figure 5:
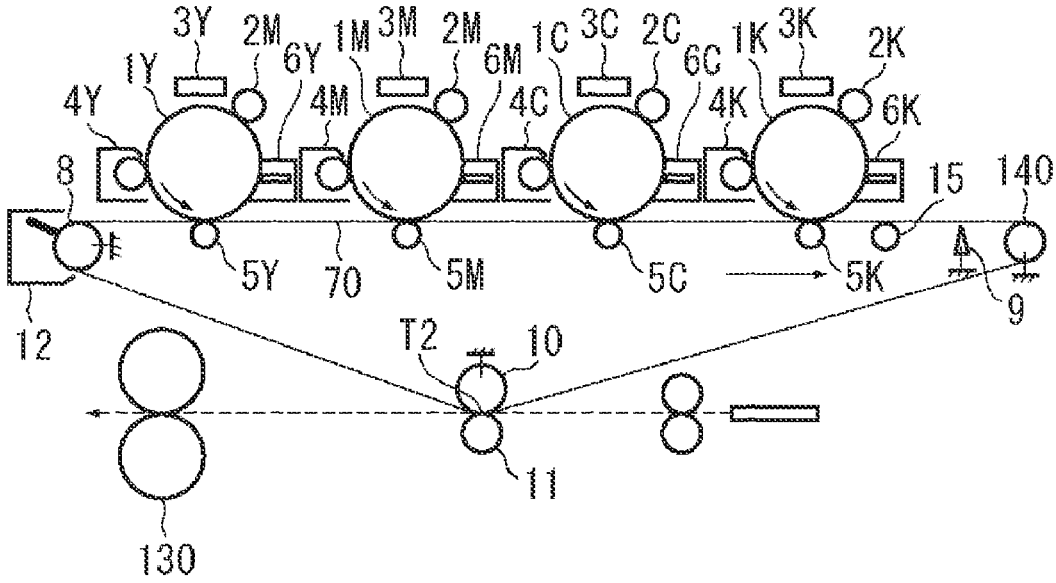
FIG. 5 illustrates a schematic diagram of an image forming apparatus according to a second exemplary embodiment.
Figure 6:
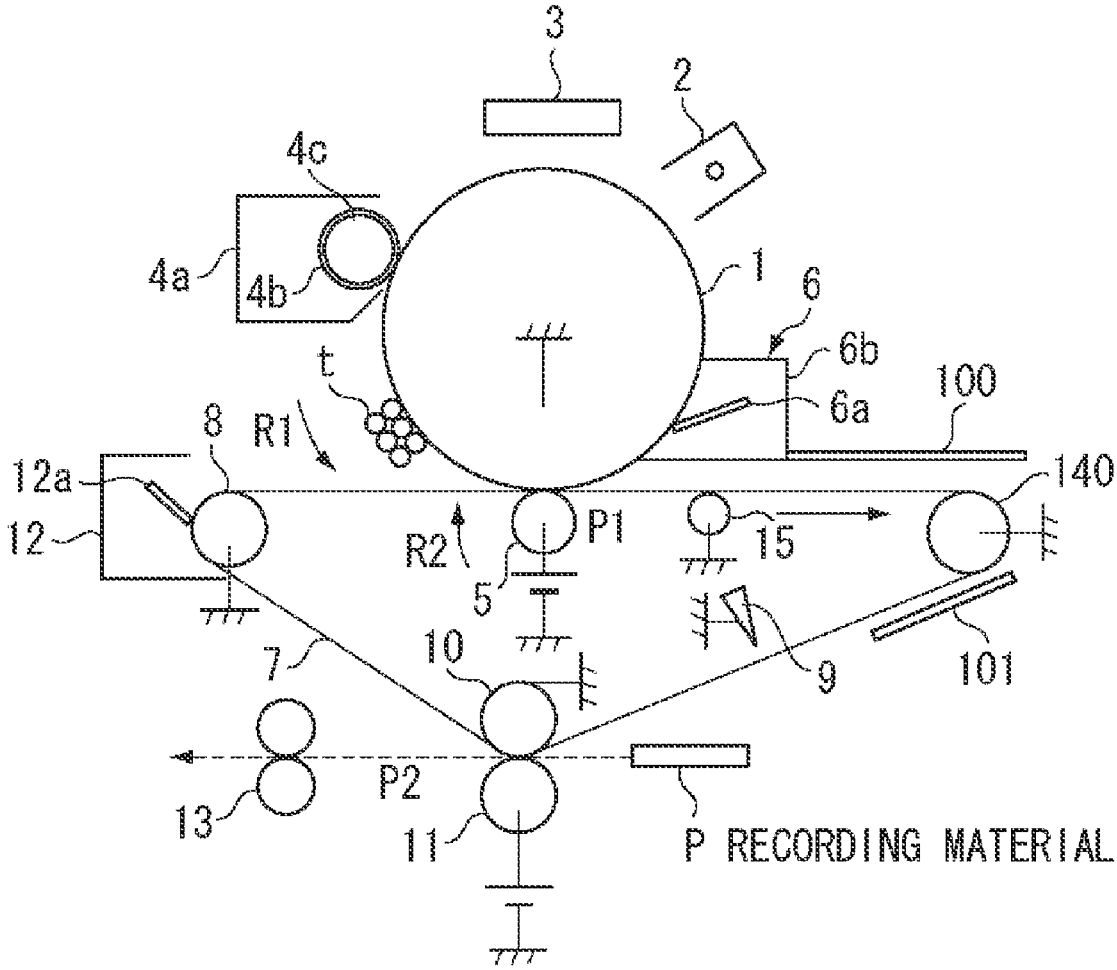
FIG. 6 illustrates a schematic diagram of an image forming apparatus according to a third exemplary embodiment.
Figure 7:
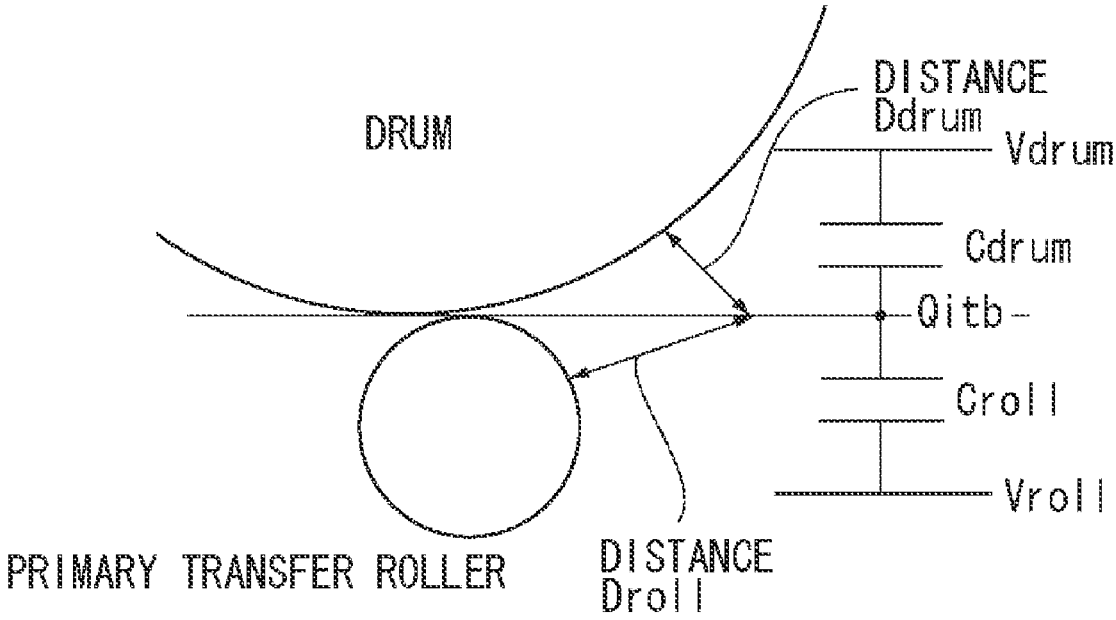
FIG. 7 is a diagram illustrating a variation in belt electric potential after primary transfer.
Figure 8:
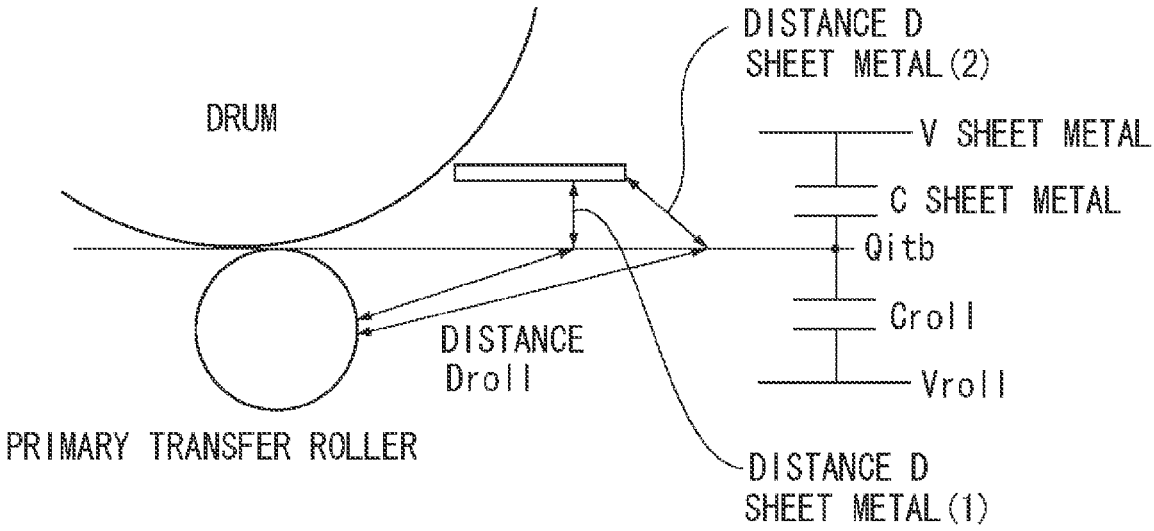
FIG. 8 is a diagram illustrating a variation in belt electric potential after primary transfer.

A schematic diagram of a printer unit of the image forming apparatus in the second exemplary embodiment is illustrated in FIG. 5.

As illustrated in FIG. 5, the present exemplary embodiment adopts a tandem type image forming apparatus in which four color image forming units of yellow (Y), magenta (M), cyan (C) and black (K) are arranged in a line.

In the image forming apparatus as illustrated in FIG. 5, photosensitive drums 1Y, 1M, 1C and 1K are image carriers. Electricity charging devices 2Y, 2M, 2C and 2K electrically charge the photosensitive drums. Exposure devices 3Y, 3M, 3C and 3K form an electrostatic latent image on the electrically charged photosensitive drums by exposure. Development devices 4Y, 4M, 4C and 4K develop the electrostatic latent image formed on the photosensitive drums by a toner. Primary transfer rollers 5Y, 5M, 5C and 5K are primary transfer members for transferring a toner image formed on the photosensitive drums on the intermediate transfer belt 7. The primary transfer rollers 5Y, 5M, 5C and 5K are similar to the transfer roller used in the first exemplary embodiment.

In each image forming unit, the photosensitive drums 1Y to 1K are electrically charged respectively in the primary electricity charging devices 2Y to 2K. Then, exposure corresponding to an input image signal is implemented by the exposure devices 3Y to 3K, thereby forming the electrostatic latent image on the photosensitive drums 1Y to 1K respectively. Thereafter, in the development devices 4Y to 4K, a toner image is developed respectively. In the present exemplary embodiment, the development devices contains a two component developer including a carrier and a toner. Thus, the toner image is formed on the respective photosensitive drums.

With respect to a development bias in the present exemplary embodiment, development is carried out with a variable development bias which can vary a direct current (DC) component.

The toner image formed on the photosensitive drums 1Y to 1K is transferred onto an intermediate transcript 70 in order by applying a primary transfer bias to the primary transfer rollers 5Y to 5K. As a result of this, a full color image is formed on the intermediate transfer belt.

A toner remaining on the photosensitive drums after primary transfer is removed by cleaning devices 6Y to 6K respectively.

The toner image transferred onto the intermediate transfer belt 70 is secondarily transferred onto a recording material in a secondary transfer portion T2. In the present exemplary embodiment, similarly to the first exemplary embodiment, the secondary transfer portion T2 is formed from the secondary transfer internal roller 10 and the secondary transfer external roller 11. Further, the rollers similar to the secondary transfer internal roller 10 and the secondary transfer external roller 11 used in the present exemplary embodiment are used in the first exemplary embodiment.

The toner image transferred onto the recording material in the secondary transfer portion T2 is fixed by a fixing device 130, so that a full color image can be obtained. A toner remaining on the intermediate transfer belt 70 after the transfer process in the secondary transfer portion T2 is removed by the belt cleaning device 12.

The intermediate transfer belt 70 in the present exemplary embodiment is rotated at a speed (300 mm/s) similar to a photoreceptor.

A steering roller 140, which is a first tension member, is inclined, thereby revising a bias in the width direction of the intermediate transfer belt in the intermediate transfer belt 70. When the steering roller 140 is inclined, a nip shape of the primary transfer portion (more specifically, amount of belt wound around photosensitive drum 1K) is changed in the utmost downstream part (image forming unit K) of the image forming apparatus. In order to make an influence of this change on an image small, as a second tension member, the tension roller 15 is disposed between a primary transfer roller 5K and the steering roller 140. Further, the driving roller 8, which is a third tension member, is rotated by a motor and transmits a driving force of the motor to the intermediate transfer belt 70.

In the image forming apparatus including a plurality of image forming units as described above, each of the photoreceptor cleaning device 6 and the development device 4 is made of SUS and grounded.

Further, in order to stabilize the electric potential of the intermediate transfer belt among image forming apparatuses of each color, the cleaning device 6 and the development device 4 are disposed keeping a distance about 5 mm apart from the intermediate transfer belt 7.

In the present exemplary embodiment, as illustrated in FIG. 5, the electric charge elimination needle 9 is disposed in a position going over a cleaning device 6K of the image forming unit K positioned most downstream in a travel direction of the intermediate transfer belt 70. In the present exemplary embodiment, a positional relation among the primary transfer roller 5K, the tension roller 15 and the steering roller 140 is similar to the first exemplary embodiment. Further, the outside diameter of the steering roller 140 is 40 mm similarly to that of the first exemplary embodiment.

A configuration of the electric charge elimination needle 9 in this present exemplary embodiment is similar to that of the electric charge elimination needle 9 in the first exemplary embodiment. The electric charge elimination needle 9 is disposed in a position similar to that in first exemplary embodiment. When an electric discharge trace has been checked similarly to the first exemplary embodiment, the electric discharge trace has not occurred when an inflow electric current into the electric charge elimination needle is about 2.0 μA.

As described above, also in an apparatus including a plurality of image forming units, the electric charge elimination needle has been disposed on the side more downstream than the metal unit to be disposed corresponding to the intermediate transfer belt of the utmost downstream image forming unit in a travel direction of the intermediate transfer belt. This disposition can make an increase in the electric potential of the intermediate transfer belt small. Further, the electric charge elimination member is disposed on the side more upstream than the first tension roller with which the intermediate transfer belt comes into contact going over the metal unit. Accordingly, the electric charge elimination effect can be further improved.

The third exemplary embodiment relates to a configuration in which another metal sheet for stabilizing the surface electric potential of an intermediate transfer belt is newly arranged. The configuration in the present exemplary embodiment is illustrated in FIG. 10. The present exemplary embodiment is configured to provide a first metal sheet 100 and a second metal sheet 101 in addition to the configuration in the first exemplary embodiment. Further, in the present exemplary embodiment, a tension roller serves as the steering roller 140. Other configurations are similar to those in the first exemplary embodiment. Thus, the description will be omitted.

The present exemplary embodiment is configured to incline the steering roller 140 to revise the bias of a belt in the width direction of the intermediate transfer belt 7. When the steering roller 140 is inclined, the surface of the belt will be inclined between the primary transfer portion P1 and the steering roller 140. Thus, when the electric charge elimination needle 9 is provided in this area, an interval between the electric charge elimination needle 9 and the surface of the belt is different. Hence, unevenness in an electric charge elimination effect by the electric charge elimination needle 9 may occur. Thus, in the present exemplary embodiment, the electric charge elimination needle 9 is not provided in this area.

On the other hand, if the electric charge elimination needle 9 is not provided in this area, the electric potential of the intermediate transfer belt 7 will increase after going over the cleaning device 6. As a result of this, an electric discharge may be generated on the steering roller 140 and it is possible that an electric discharge trace occurs.

Accordingly, the present exemplary embodiment has newly provided the first metal sheet 100 grounded in an area opposite to the intermediate transfer belt 7 in this area. In this configuration, an increase in an electric potential in this area can be suppressed to be small. On the other hand, in order to stabilize an electric potential, the second metal sheet 102 has been disposed also on the downstream side of the steering roller 140 in a travel direction of the intermediate transfer belt 7. An interval between the first metal sheet 100 and the surface of the intermediate transfer belt 7, and an interval between the second metal sheet 101 and the surface of the intermediate transfer belt 7 are 5 mm respectively.

In such a configuration, the present exemplary embodiment disposes the electric charge elimination needle 9 from the end of the second metal sheet until the electric charge elimination needle 9 is brought into contact with a tension roller which has been grounded first. In the present exemplary embodiment, the tension roller which has been grounded first is the secondary transfer internal roller 10.

In the present exemplary embodiment in which the metal sheet is newly provided, the electric charge elimination needle is disposed on the side more downstream than the utmost downstream metal sheet and on the side more upstream than the tension roller present on the utmost upstream side, among the tension rollers which are present on the side more downstream than the utmost downstream metal sheet in a travel direction of an intermediate transfer belt.

In such a configuration, an increase in the electric potential of the intermediate transfer belt on the side more downstream than its component in a travel direction of the intermediate transfer belt can be made small even if a metal member is included which restricts the electric potential of the intermediate transfer belt at a narrow interval. The exemplary embodiments of the present invention have been described above. However, the present invention is not limited to any exemplary embodiment described above and any changes is possible without departing from the spirit of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-020237 filed Jan. 30, 2009, which is hereby incorporated by reference herein in its entirety.

What is claimed is:

1. An image forming apparatus comprising:

an image forming unit configured to have an image carrier to form a toner image on the image carrier;

a rotatable intermediate transfer belt for bearing the toner image transferred from the image carrier;

a plurality of tension members for tensing the intermediate transfer belt;

a primary transfer unit configured to transfer the toner image formed on the image carrier onto the intermediate transfer belt;

a secondary transfer unit configured to transfer the toner image formed on the intermediate transfer belt onto a recording material;

a sheet metal unit disposed with a preset interval between itself and a face on which the intermediate transfer belt carries the toner image, on the side more downstream than the primary transfer unit and on the side more upstream than the secondary transfer unit in a travel direction of the intermediate transfer belt; and a noncontact electric charge elimination member for eliminating an electric charge of the intermediate transfer belt which is disposed on the side more downstream than the metal unit and on the side more upstream than the secondary transfer unit in the travel direction, and is provided in noncontact with the intermediate transfer belt, opposing the side adverse to the face on which the intermediate transfer belt carries the toner image.

2. The image forming apparatus according to claim 1, wherein the noncontact electric charge elimination member is disposed on the downstream side of the metal unit and on the side more upstream than the tension member which first comes into contact with the intermediate transfer belt in the travel direction.

3. The image forming apparatus according to claim 1, further comprising:

a plurality of image forming units including an image carrier and an toner image forming unit configured to form a toner image on the image carrier, wherein the noncontact electric charge elimination member is provided on the side more downstream than the utmost downstream image forming unit in a travel direction of the intermediate transfer belt.

4. The image forming apparatus according to claim 1, wherein all of the plurality of tension members are grounded.

5. The image forming apparatus according to claim 1, wherein the length of the noncontact electric charge elimination member in a direction orthogonal to the travel direction is longer than a maximum image forming width on the intermediate transfer belt.

6. The image forming apparatus according to claim 1, further comprising:

a steering roller for controlling a position in a direction orthogonal to the travel direction of the intermediate transfer belt by an inclination, wherein the noncontact electric charge elimination member is disposed closer to the side of the metal unit than a midpoint between the steering roller and the end of the metal unit.

7. The image forming apparatus according to claim 1, further comprising:

a steering roller for controlling a position in a direction orthogonal to the travel direction of the intermediate transfer belt by an inclination, wherein the noncontact electric charge elimination member is disposed on the side more downstream than the steering roller in the travel direction.

* * * * *